United States Patent [19]

Brackett

[11] Patent Number: 4,926,889

[45] Date of Patent: May 22, 1990

[54] APPARATUS FOR TREATING TOBACCO PRODUCTS

[76] Inventor: George E. Brackett, 9897 Treasure Cay Ln., Bonita Springs, Fla. 33923

[21] Appl. No.: 195,965

[22] Filed: May 19, 1988

Related U.S. Application Data

[63] Continuation-in-part of Ser. No. 940,063, Dec. 10, 1986.

[51] Int. Cl.[5] ..... A61K 13/00; A61K 13/08

[52] U.S. Cl. ..... 131/329; 131/173; 131/335; 131/300

[58] Field of Search ..... 131/329, 335, 173, 274, 131/281, 31, 62, 79, 290, 300, 301, 302, 303, 304

[56] References Cited

U.S. PATENT DOCUMENTS 2,895,651 2/1956 Mahon et al. .
2,913,154 11/1959 Kuffer .
3,232,493 2/1966 Beard, Jr. .
3,319,632 5/1967 Burbig .
3,779,787 12/1973 Haslam et al. .
4,233,995 11/1988 Kotuby .

*Primary Examiner*—V. Millin

*Attorney, Agent, or Firm*—Lerner, David, Littenberg, Krumholz & Mentlik

[57] ABSTRACT

Apparatus for concurrently puncturing the sidewalls of and moistening elongate, generally cylindrical tobacco products is disclosed. The apparatus includes a body member, and a container for liquid cooperative with the body member and provided with liquid discharge means for delivering liquid therefrom. The apparatus also includes a push button member movable relative to the body member between an actuated and a deactuated position and cooperative with the liquid discharge means, when actuated, for delivering liquid from the liquid discharge means. One or the other of the body member and the push button member includes a means for supporting a tobacco product thereon, and means are provided for conducting liquid delivered from the liquid discharge means to the tobacco product. The apparatus further includes a means carried by one or the other of the body member and the push button member which is responsive to movement of the push button member to its actuated position for puncturing the side wall of the tobacco product, whereby the tobacco product is concurrently punctured and moistened when the push button member is actuated.

27 Claims, 3 Drawing Sheets

1/3

APPARATUS FOR TREATING TOBACCO PRODUCTS

CROSS REFERENCE TO RELATED APPLICATION

This application is a continuation-in-part of application Ser. No. 940,063, filed Dec. 10, 1986.

BACKGROUND OF THE INVENTION

The present invention relates to apparatus for treating tobacco products and, more particularly, to apparatus for concurrently perforating the sidewalls of and moistening elongate cylindrical tobacco products such as cigarettes and cigars.

It has long been recognized that the deleterious effects of smoking may be mitigated to some degree, and that smokers may be aided in their efforts to break the smoking habit, by reducing the quantities of undesirable gases and particulate matter in the smoke they inhale. This can be done by aerating the smoke drawn from cigarettes and cigars via transverse puncture ducts made in the sidewalls thereof, and by using moisteners to moisten such tobacco products, particularly the filter tips thereof when so equipped, to facilitate the removal of harmful constituents from the aerated tobacco smoke by the moistened filter and/or by the moistened tobacco. It is generally not practical either to pre-puncture or to pre-moisten tobacco products prior to their distribution and sale since, in the case of pre-puncturing, not all smokers are desirous of having their smoke aerated, and separate manufacturing, packaging and distributing facilities would have to be set up for the pre-punctured tobacco products. Similarly in the case of pre-moisturizing, the moisture would tend to evaporate and dry out between the time that it was applied to the tobacco product and the time that the tobacco product was consumed by the smoker. Accordingly, various devices have been proposed heretofore for use by the individual smoker in puncturing sidewalls of tobacco products or in moisturizing either the entire tobacco product or the filter tip thereof alone.

With respect to puncturing the sidewalls of tobacco products, Landuydt, U.S. Pat. No. 4,263,923, discloses a perforator for cigarettes. The perforator includes a support-base having a projection extending from one of its sides. The projection has a notch adapted to freely receive a cigarette adjacent to the support-base. A pin projects from the support-base on the same side as the projection, facing the notch for insertion into a cigarette positioned in the notch. The perforator includes means thereon by which it attaches to the end of a cigarette lighter opposite from that end thereof used to light cigarettes. Thompson, U.S. Pat. No. 4,463,770, also discloses a perforator for smoking articles such as cigarettes, cigars and the like. The perforator includes a body having a cylindrical aperture in the lower portion thereof and an overfitting cap reciprocally mounted over the upper portion of the body. The reciprocal cap carries a plunger therewith that is provided with pins which extend through the aperture in the body when the cap is depressed, transversely puncturing any smoking article located therein. A spring member position between the plunger and the body biases the cap, plunger and pins to remove the pins from the body aperture when the cap is released.

With respect to moisturizing tobacco products, Burbig, U.S. Pat. No. 3,319,632, discloses a moisturizer in the form of a generally cylindrical squeeze bottle. The bottle is provided with a cylindrical receptacle for receiving the filter end of a cigarette and holding the cigarette so that the cigarette is generally coaxial with the container. A needle mounted within the cylindrical receptacle impales the cigarette filter so that fluid dispensed from within the bottle, as by squeezing, will be forced into the filter and moisturize the same. Kotuby et al, U.S. Pat. No. 4,233,995, discloses a rather complex device including an elongate cylindrical cigarette receiving receptacle, an elongate hollow needle disposed within that receptacle and an external housing surrounding the receptacle. The external housing has various components adapted to hold a small, generally cylindrical aerosol dispensing unit having a hollow actuating stem so that the axis of the dispensing unit extends generally parallel to the axis of the cigarette receiving receptacle. Other components are provided for connecting the hollow stem of the aerosol dispenser with the interior of the needle. In use, a cigarette is impaled on the needle and the aerosol dispenser is actuated by moving the aerosol dispenser relative to the external housing. Fluid from the dispenser flows through the hollow stem of the dispenser and through the needle into the cigarette.

The foregoing devices, and other devices developed heretofore for puncturing or moistening tobacco articles, have not been widely accepted in the market place because they have not been particularly convenient to carry and/or use and because separate puncturing and moisturizing devices have been needed to accomplish both tasks. Typically these devices have been ill suited to one-handed operation, and have not been used in situations where one hand is required for other activities, as, for example, while driving an automobile or the like. Moreover, any of such devices proposed heretofore have been rather bulky and cumbersome and relatively expensive to manufacture and thus unsuitable for sale as disposable items.

In addition to the foregoing prior art examples of puncturing and moisturizing devices, an improved moistening device is shown and described in the co-pending application of George E. Brackett, Ser. No. 940,063, filed Dec. 10, 1986, which application is assigned to the assignee of the present application. The disclosure of the aforesaid co-pending application is incorporated by reference into the present application. In said co-pending application the moistening device utilizes a small, stem-actuated dispenser, such as a pressure-charged aerosol type dispenser or a pump type dispenser small enough to be held in the palm of a normal human hand. The moistening device also includes a push button mounted on the stem, the push button having a button body defining a tobacco-product-receiving bore extending in a bore direction, the bore having an open end and being adapted to receive the end of a tobacco product so that such product also extends in the bore direction. The bore communicates with the hollow stem. When the end of a tobacco product is engaged in the bore, the axis of such product extends substantially in the bore direction, transverse to the stem direction and to the axis of the container, facilitating holding the device and the engaged tobacco product in one hand, and facilitating actuation of the device by pushing on the button with the thumb of the same hand. Upon actuation, a liquid discharged from the container enters the bore and moistens the end of the tobacco product.

Although the aforesaid co-pending application represents a significant step forward insofar as moisturizing devices for tobacco products are concerned in that it provides for a relatively inexpensive, disposable moistening device suited to one-handed operation, it does not include provision therein for puncturing the sidewalls of the tobacco products to facilitate aerating the smoke inhaled by the smokers.

Accordingly, it is a primary object of the present invention to provide an improved device for treating tobacco products in order to modify the combustion products of the tobacco and render the same more acceptable to the smoker.

It is another object of the present invention to provide a device for both perforating and moistening tobacco products for reducing the quantities of undesirable gasses and particulate matter in the combustion products thereof.

An additional object of this invention to provide a hand-held, disposable device for use by a consumer in perforating and moistening tobacco products just prior to their consumption.

Further objects and advantages of this invention will become apparent as the following description proceeds.

SUMMARY OF THE INVENTION

Briefly stated, and in accordance with one embodiment of this invention, there is provided an apparatus for treating tobacco products. The apparatus includes a body member; a push button member movable relative to the body member between an actuated position and a de-actuated position; means for supporting a tobacco product on one of the members; means responsive to movement of the push button member to its actuated position for supplying a moistening liquid to the tobacco product; and means responsive to movement of the push button member to its actuated position for puncturing the sidewall of the tobacco product, whereby when the push button member is actuated the tobacco product is concurrently punctured and moistened.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

DETAILED DESCRIPTION OF THE PREFERRED EMBODIMENTS

Figure 1:
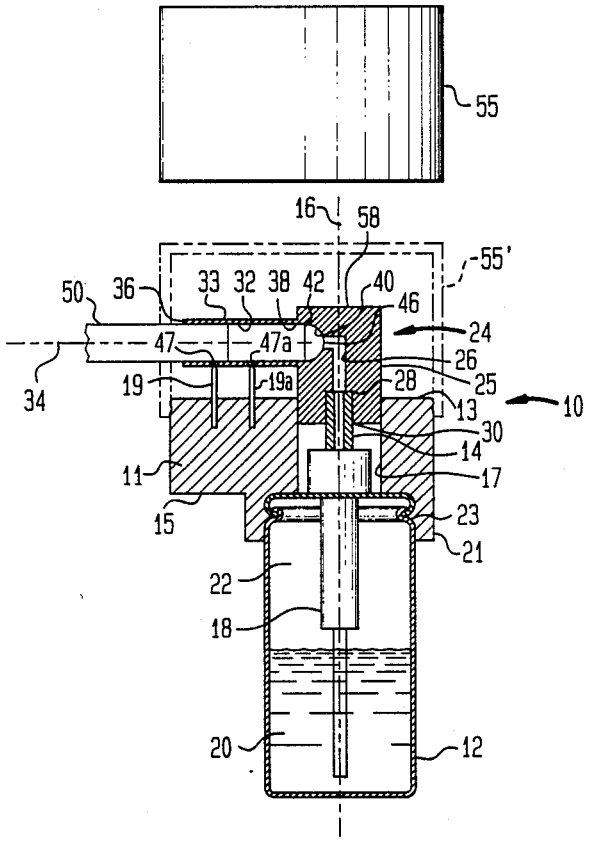
FIG. 1 is a schematic sectional view of an apparatus for puncturing and moistening tobacco products, according to one embodiment of the present invention.
Figure 2:
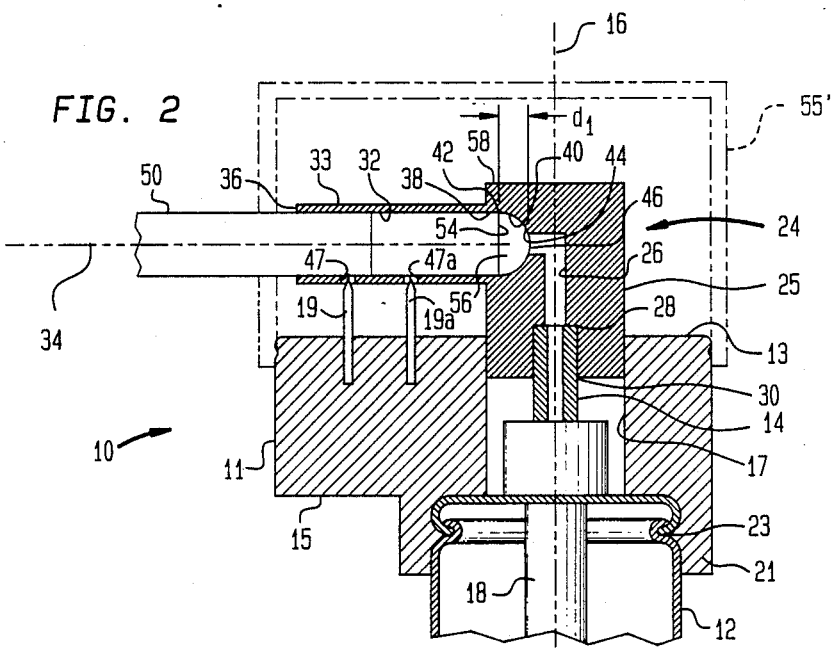
FIG. 2 is a fragmentary, schematic sectional view, on an enlarged scale, depicting a portion of the apparatus shown in FIG. 1.
Figure 3:
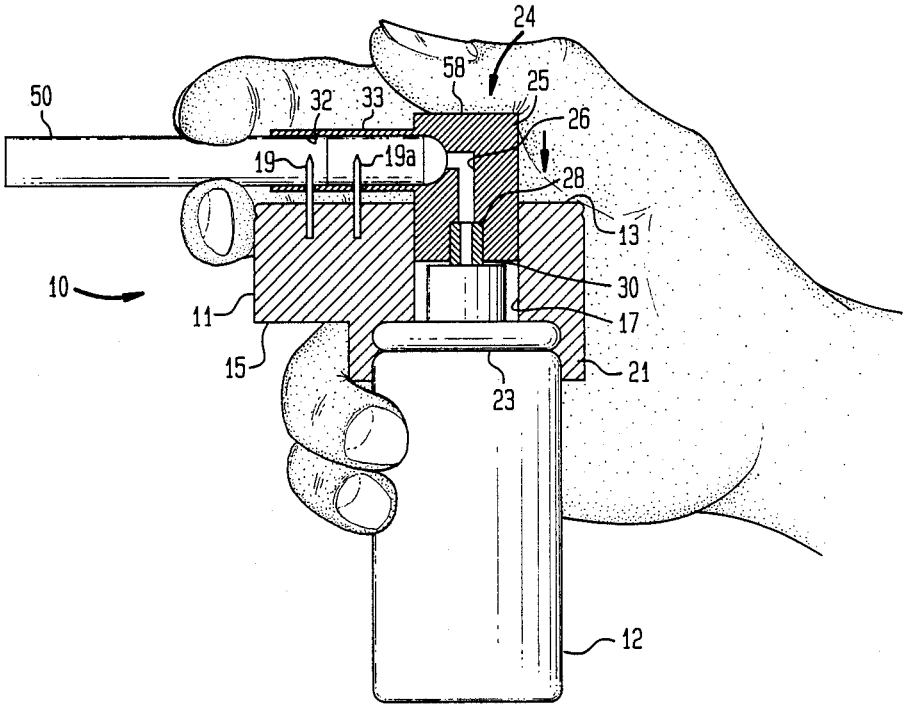
FIG. 3 is a schematic elevational view depicting the apparatus of FIGS. 1 and 2 in use.

Referring to FIGS. 1–3, an apparatus for concurrently puncturing the sidewalls of and moistening elongate, generally cylindrical tobacco products in accordance with one embodiment of the present invention has there been illustrated generally at 10. The apparatus 10 comprises a generally cylindrical container body 12 that is approximately 1 inch in diameter and approximately 2½ inches long. The apparatus 10 also includes a hollow tubular stem 14 which is movably mounted to container 12. The axis of the stem is parallel to, and coincident with, an axis 16 of cylindrical container 12. Stem 14 is movable over a limited range relative to container 12, in directions parallel to container axis 16, between a rest position and a displaced position. A suitable tobacco product moistening liquid is disposed within container 12, and the container is provided with a discharge device 18 for discharging the liquid 20 through hollow stem 14 when the stem is moved to its displaced position. Discharge device 18 includes a conventional valve, and the liquid discharge is preferably assisted by a pressurized, vaporizable propellant 22, also disposed within the container. However, the discharge device 18 may also be a conventional pump type device, in which case the propellant 22 is not required. The stem-actuated container per se is conventional, and, accordingly, need not be described in further detail herein. As well known to those skilled in the packaging art, such containers can be fabricated, filled and closed using conventional, widely available high speed equipment.

The tobacco product treatment apparatus 10 also comprises a body member 11 having an upper surface 13 and a lower surface 15 thereon. An opening 17 is provided in the body member 11. The opening 17 extends through the body member from the upper surface 13 to the lower surface 15 thereof. The lower surface 15 of the body member 11 is provided with a downwardly extending internally ribbed, annular flange 21, the internal rib of which engages a circumferentially extending recess 23 formed in the outer peripheral surface of the container body to 12 to securely but removably hold container 12 in place adjacent to the lower surface 15 of the body member, with the hollow tubular stem 14 of the container projecting into the opening 17 of the body member. The container 12, thus, may be easily removed and replaced by a new, full, container 12 when its liquid contents have been used up.

The tobacco product treatment apparatus 10 also includes a push button, shown generally at 24, which is mounted on stem 14. Push button 24 has a body 25 which is generally cylindrical in shape and is provided with a stem bore 26 (FIG. 2) coincident with its axis. Stem bore 26 is also provided with a shoulder 28 which abuts the end of stem 14 when the stem is received in stem bore 26 through an open end 30 of the stem bore. Those portions of stem bore 26 adjacent open end 30 are dimensioned to provide a press fit with the exterior of stem 14 and, hence, in conjunction with shoulder 28, provide means for mounting the push button 24 on the stem 14. Because the axis of the stem bore is substantially coincident with the axis defined by the cylindrical push button body 25, the axis of the push button body is substantially coincident with the axis of the stem 14 and, hence, is coincident with the axis 16 of container 12 (FIG. 1) as well when the push button is mounted on the stem.

Push button body 25 is also provided with a tobacco-product-receiving bore 32 formed at least in part by a cylindrical wall member 33 which projects from a side surface of the body 25. Bore 32 has a bore axis 34 substantially transverse to the axis 16 of stem bore 26. Thus, when push button 24 is mounted on stem 14, the tobacco-product-receiving bore axis 34 extends transverse to the axis of stem 14 and transverse to container axis 16. Tobacco-product-receiving bore 32 has an open end 36, an internal peripheral wall portion 38 within push button body 25 that extends around bore axis 34 and an end wall portion 40 extending across the bore remote from open end 36, thereby defining a substantially closed end of the bore. End wall 40 is concave towards open end 36 (i.e., the wall slopes toward open end 36 adjacent peripheral wall 38). In the embodiment illustrated in FIGS. 1 and 2, the end wall 40 has a generally spherical curvature. End wall 40 has a peripheral portion 42 and a central portion 44. A nozzle hole 46 extends through the central portion 44 of end wall 40, so that the end wall defines a nozzle facing towards open end 36 of bore 32. Nozzle hole 46 communicates with the interior of stem bore 26. Accordingly, the interior of bore 32 is placed in communication with the interior of hollow stem 14 by way of nozzle hole 6 and stem bore 26 when the push button 24 is mounted on stem 14.

Assuming that tobacco-product-treatment apparatus 10 is designed for use in treating cigarettes, the bore 32 will be a cigarette receiving bore adapted to receive the filter tip end of a common filter tip type cigarette 50, as shown in FIGS. 1–3, so that the cigarette extends generally along bore axis 34. In this case, the bore 32 will be approximately 5/16 of an inch in diameter so that the peripheral wall members 33 and 38 provide a light press fit with the exterior surface of the cigarette and its filter tip. As best seen in FIG. 2, the end surface 54 of the cigarette filter tip inserted into bore 32 abuts the peripheral portion 42 of bore end wall 40. The peripheral portion of the bore end wall thus serves as a stop which retains the end surface 54 of the cigarette filter tip at a predetermined distance $d_1$ away from the central portion 44 of bore end wall 40, and at the same predetermined distance away from nozzle hole 46, so that the cigarette filter tip end surface and the concave bore end wall surface cooperatively define a chamber 56. The distance $d_1$ preferably is between about $\frac{1}{8}$ and about $\frac{3}{8}$ inches and more preferably between about $\frac{1}{4}$ and about $\frac{3}{8}$ inches.

The lower portion of wall member 33 is provided with apertures 47 and **47*a* that are aligned with the ends of respective pins 19 and 19*a* projecting upwardly from the upper surface 13 of body member 11. Accordingly, when push button 24 is depressed, the filter cigarette 50 carried in bore 32 moves downwardly and is radially pierced by the upwardly projecting tips of pins 19 and 19*a* which project into the bore 32. The arrangement is such that the push button 24 moves downwardly a sufficient amount, when depressed, to allow the pins 19 and 19*a* to radially puncture the cigarette 50** to a depth that is preferably at least equal to the radius of the cigarette (i.e., about 5/32 of an inch).

An overcap 55 is provided for covering push button 24 and bore-forming wall member 33 when the apparatus 10 is not in use, as indicated at 55' in FIG. 1. The overcap 55 is arranged to provide a frictional fit with the exterior peripheral surface of body member 11, adjacent to the upper surface 13 thereof. When the device is to be used, overcap 55 is removed. In use, when push button 24 is actuated, the liquid 20 (FIG. 1) is discharged through the hollow stem 14, through stem bore 26 and nozzle 46, into bore 32 and the chamber 56 defined at the inward end of the bore by the cigarette filter and by the end wall 40. The space within chamber 56 aids in distributing the moistening fluid transversely of bore axis 34 and hence aids in moistening the filter substantially across its width. Concurrently, the depression of push button 24 causes the pins 19 and **19*a* to radially penetrate the filter cigarette at two axially spaced locations upstream of the portion of the filter tip cigarette that normally enters the users mouth, so that when the cigarette is subsequently smoked the products of combustion will be aerated by a flow of air into the smoke stream. The depth of penetration of the pins 19 and 19*a* to the cigarette 50** is preferably at least equal to the radius of the cigarette, as indicated earlier.

The apparatus 10, and the cigarette 50 engaged therewith, can be held conveniently and actuated with one hand. Thus, the cigarette can be grasped between the first and second fingers, the container 12 can be held between the pinky and ring fingers and the palm, and push button 24 can be engaged by the thumb of the same hand, all as shown in FIG. 3. As will be appreciated from FIG. 3, this particularly convenient mode of operation is greatly facilitated by the orientation of bore axis 34, and hence cigarette 50, transverse to container axis 16. In particularly preferred embodiments, the bore axis can intersect the axis of stem bore 26 (FIG. 2) and hence the container axis 16 either at an angle of exactly 90°, as illustrated, or else at a somewhat lesser angle of, for example, between about 75° and about 90°, provided the lengths of the pins 19 and **19*a* and the orientations of apertures 47 and 47*a*** are suitably adjusted to accommodate the angular change in the latter case.

To facilitate holding the apparatus 10 and also to facilitate storage, as in a pocket or purse, the container 12 should preferably be less than about $1\frac{1}{2}$ inches in diameter, and most preferably is between about 1 inch and $1\frac{1}{4}$ inch in diameter. As illustrated, the container 12 is substantially in the form of a circular cylinder. However, other elongated forms of containers, such as a rectangular solid, or a cylinder having as its base an ellipse or other like figures can be employed. With respect to elongated containers other than cylinders, the largest dimension transverse to the axis of the elongation should be considered as the diameter. Preferably, the diameter of the portion of push button 24 which moves within the aperture 17 of body member 11 should be slightly more than one-half of the diameter of the container 12 and the projecting portion of wall member 33 should have a length of about equal to or slightly greater than the diameter of the circular portion of push button 24. Thus, the circular portion of push button 24 may preferably have a diameter between about $\frac{1}{2}$ inch and about $\frac{3}{4}$ inch and the length of the protruding wall member 33 will be similarly dimensioned. Also, the push button may be provided on its top surface 58 with an indentation, knurling or the like to facilitate engagement by the user's thumb. The length of the entire device, from the top surface of push button 24 to the bottom end of container 12, is desirably less than about 4 inches and more preferably is between about $3\frac{1}{4}$ inches and $3\frac{1}{2}$ inches.

The nozzle hole or orifice 46 preferably is 0.005 inches to 0.050 inches in diameter, most preferably about 0.010 inches in diameter. The nozzle hole or orifice typically is about 0.025 inches to about 0.125 inches long, most preferably about 0.050 inches long. Desirably, the nozzle dimensions are matched with the characteristics of the treatment apparatus 10 so that between about 0.05 cc and about 0.5 cc of liquid, and most preferably about 0.020 cc of liquid, are discharged through the orifice on each actuation. The most preferred orifice dimensions noted above are intended to provide optimum delivery for an aerosol type container 12 holding an aqueous fluid under about 100 pounds per square inch gage pressure.

Figure 4:
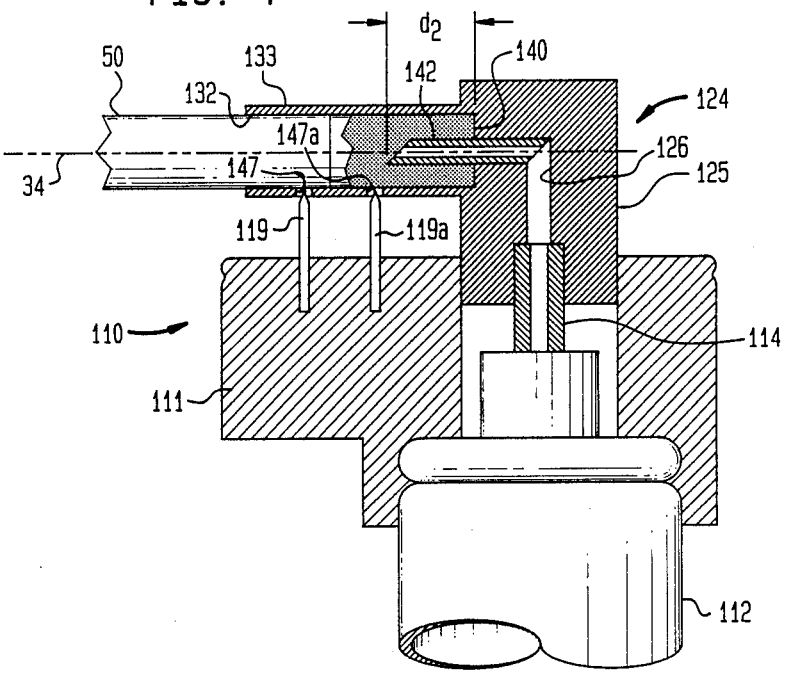
FIG. 4 is a view similar to FIG. 2 but depicting a portion of the apparatus according to a further embodiment of the present invention.

A tobacco product treatment apparatus according to a further embodiment of the present invention is illustrated generally at 110 in FIG. 4. Apparatus 110 includes a push button member 124 generally similar to the push button member described above with reference to FIGS. 1–3 and including a body portion 125 having a generally similar stem bore 126 for receiving the stem 114 of a container 112. As designed for use in treating cigarettes, the push button member 124 has a cigarette receiving bore 132 formed in part by a cylindrical wall member 133. The axis 134 of the cigarette receiving bore extends generally perpendicular to the axis of stem bore 126. However, the end wall 140 of bore 132 is substantially flat. A hollow metallic needle 142 extends through end wall 140 substantially on bore axis 134 and hence co-axially with bore 132. Needle 142 is preferably permanently affixed to the push button 124 by means of glueing, insert molding, ultrasonic insertion, or the like, to insure that it remains permanently attached to the push button. If insert molded (i.e., the needle 142 being present in the mold during the injection molding cycle of the push button 124) the needle 142 preferably would have a shoulder formed at its right end (as viewed in FIG. 4) which would prevent it from being pulled out of the push button when a cigarette 50 is removed from the bore 132 after being punctured and moisturized. Apparatus 110 also includes a body member 111 which carries pins 119 and **119*a* that puncture the sidewall of a tobacco product 50 when the push button member 124 is actuated, in the same manner as described earlier in connection with FIGS. 1–3**.

Figure 5:
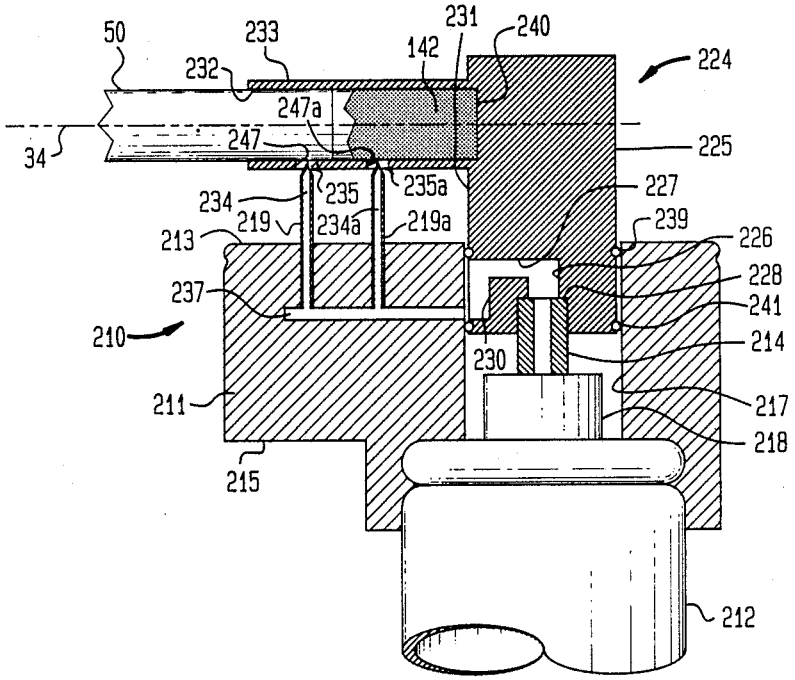
FIG. 5 is a view similar to FIGS. 2 and 4 but depicting a portion of the apparatus according to yet another embodiment of the present invention.

A tobacco product treatment apparatus according to yet another embodiment of the present invention is illustrated generally at 210 in FIG. 5. Apparatus 210 includes a body member 211 which carries hollow pins 219 and **219*a* on an upper surface 213 thereof and carries a liquid container 212 adjacent a lower surface 215 thereof. Liquid container 212 is provided with a liquid discharge device 21B which includes a hollow stem 214 that extends into an opening 217 in body member 211 and supports a push button member 224 thereon. The push button member 224 includes a body portion 225 the outer surface 231 of which slideably engages the periphery of opening 217 in a substantially fluid tight engagement. Upper and lower Elastomeric "O" rings 239 and 241, respectively, may be provided between the surface 231 and the wall of opening 217, near the upper surface 213 of body member 211 and near the bottom surface of the push button body 225, to prevent leakage therebetween. The upper end of hollow stem 214 abuts against, and sealingly engages with, a shoulder 228 in push button body 225**.

A conduit 226 that is axially aligned with the hollow stem 214, and a conduit 227 that is transverse to and communicates with conduit 226, are provided within push button body 225. Conduit 227 connects with a groove 230 formed in the outer surface 231 of push button body 225, which groove is aligned with a conduit 237 formed in body member 211. Conduit 237, in turn, communicates with conduits 234 and **234*a* formed in the hollow needles 219 and 219*a*, respectively, and conduits 234 and 234*a* lead to respective openings 235 and 235*a*** in the walls of the needles at the upper ends thereof.

The arrangement of the various conduits in the push button member 224, body member 211 and needles 219 and **219*a* is such that when push button member 224 is depressed to move it from its de-actuated position to its actuated position, causing needles 219 and 219*a* to puncture and penetrate the sidewall of tobacco product 50, moistening liquid flows from hollow stem 214 through conduits 226 and 227, through groove 230, through conduits 237, 234 and 234*a*, and into the interior of the tobacco product 50 via the openings 235 and 235*a*** at the upper ends of the needles, which openings are at this time within the interior of the tobacco product.

As will readily be appreciated, numerous variations and combinations of the features described above can be utilized without departing from the present invention as defined in the claims. Merely by way of example the words "tobacco products" and "cigarette" have been utilized as describing the product treated by the present device. However, other tobacco products, such as substantially cylindrical cigars and other smoking items commonly referred to as "cigarillos" can be treated substantially in the same way. Accordingly, the terms "tobacco products" and "cigarettes" as utilized in this disclosure should be understood as encompassing these products as well, unless otherwise specifically indicated. Also, although it is greatly preferred to moisten the filter of a filter tip cigarette as described above, substantially the same techniques can be employed in moistening a non-filtered cigarette, if desired.

In the embodiments discussed above, the tobacco-product-receiving bore of the push button extends transverse to the stem of the dispenser, and thus extends transverse to the axis of the container which holds the liquid. This arrangement is particularly advantageous where the tobacco product treatment apparatus is to be hand held. The same arrangement can be used in apparatus intended for table top use, as where the liquid container is provided with a base for resting on a table. Other arrangements can also be used in table top apparatus. Thus, in a puncturing and moisturizing apparatus designed for use on a table top, the tobacco-product-receiving bore may extend parallel to the stem bore and suitable provision made (e.g., cams) for the puncturing pins to be actuated to move into the bore when the push button is depressed.

In another variation of the invention the tobacco-product-receiving bore 32, or other tobacco product support, can be formed on the body member 11 and the puncture pins 19 and **19*a* (or 119 and 119*a*, or 219 and 219*a*) can be carried by the push button member 24 (or 124 or 224), rather than vice versa as heretofore described. In this case suitable conduit means (e.g., a flexible tube or other form of communication) would connect the hollow stem 14 (or 114 or 224) of the liquid container with either the interior of the bore 32** or the conduits in the pins to facilitate depression of the stem by the push button and allow the tobacco product in the bore or on the support to be concurrently punctured and moistened when the push button is depressed.

While there have been shown and described what are presently considered to be the preferred embodiments of this invention, it will be obvious to those skilled in the art that various other changes and modifications may be made without departing from the broader aspects of this invention. It is, therefore, aimed in the appended claims to cover all such changes and modifications as fall within the true spirit and scope of this invention.

What is claimed is:

1. Apparatus for treating tobacco products, comprising:

(a) a body member;

(b) a push button member movable relative to said body member between an actuated position and a deactuated position;

(c) means for supporting a tobacco product on one of said members;

(d) means carried by one of said members for puncturing the sidewall of said tobacco product; and (e) means responsive to movement of said push button member to its actuated position for supplying a moistening liquid to said tobacco product.

2. Apparatus for treating tobacco products, comprising:

(a) a body member;

(b) a push button member movable relative to said body member between an actuated position and a deactuated position;

(c) means for supporting a tobacco product on one of said members;

(d) means responsive to movement of said push button member to its actuated position for supplying a moistening liquid to said tobacco product; and (e) means responsive to movement of said push button member to its actuated position for puncturing the sidewall of said tobacco product, whereby when said push button member is actuated, said tobacco product is concurrently punctured and moistened.

3. Apparatus according to any one of claims 1 and 2, wherein said liquid supplying means includes a container for liquid, said container being detachably carried by said body member and being provided with liquid discharge means for delivering liquid therefrom.

4. Apparatus according to claim 3, wherein said liquid discharge means includes a hollow stem projecting into an opening in said body member, and wherein said push button member engages and is carried by said hollow stem.

5. Apparatus according to claim 4, wherein said liquid supplying means includes conduit means formed at least in part in said puncturing means.

6. Apparatus according to claim 4, wherein said liquid supplying means includes conduit means formed at least in part in said push button member.

7. Apparatus according to claim 4, wherein said liquid supplying means includes conduit means formed at least in part in said body member.

8. Apparatus according to claim 5, wherein said liquid supplying means includes conduit means formed at least in part in said push button member.

9. Apparatus according to claim 5, wherein said liquid supplying means includes conduit means formed at least in part in said body member.

10. Apparatus according to claim 8, wherein said liquid supplying means includes conduit means formed at least in part in said body member.

11. Apparatus for concurrently perforating the sidewalls of and moistening elongate, generally cylindrical tobacco products, comprising:

(a) a body member;

(b) a container for liquid cooperative with said body member and provided with liquid discharge means for delivering liquid therefrom:

(c) a push button member movable relative to said body member and cooperative with said liquid discharge means when depressed for actuating said liquid discharge means to deliver liquid therefrom, one of said body and said push button members including wall means thereon forming a bore that is adapted to receive tobacco products therein, said bore being in communication with said liquid discharge means; and, (d) means carried by the other of said body and said push button members and projecting through said wall means when said push button member is depressed for puncturing the sidewall of said tobacco product, whereby said tobacco product is concurrently punctured and moistened when said push button member is depressed.

12. Apparatus according to claim 11, wherein said wall means is carried by said push button member and said puncture means is carried by said body member.

13. Apparatus according to claim 12, wherein said body member includes upper and lower end surfaces thereon and an opening extending therethrough from one of said surfaces to the other of said surfaces, wherein said push button member is movable within said opening and projects from said opening above said upper surface, and wherein said wall means extends from said push button member in spaced relation to said upper surface.

14. Apparatus according to claim 13, wherein said container is carried by said body member adjacent said lower surface, wherein said liquid discharge means includes a hollow stem projecting into said opening in said body member, and wherein said push button member engages and is carried by said hollow stem.

15. Apparatus according to any one of claims 13 or 14, wherein said puncturing means includes at least one pin member projecting upwardly from said upper surface, wherein said wall member includes at least one corresponding aperture therethrough aligned with said pin member, and wherein said pin member projects through the aperture in said wall member into said bore when said push button member is depressed.

16. Apparatus according to any one of claims 11 or 12, wherein said puncturing means includes at least one pin member, wherein said wall member includes at least one corresponding aperture therein aligned with said pin member, and wherein said pin member projects through the aperture in said wall member into said bore when said push button member is depressed.

17. Apparatus according to claim 16, wherein said body member includes upper and lower end surfaces thereon and an opening extending therethrough from one of said surfaces to the other of said surfaces, wherein said push button member is movable within said opening and projects from said opening above said upper surface, and wherein said wall means extends from said push button member in spaced relation to said upper surface.

18. Apparatus according to claim 17, wherein said container is carried by said body member adjacent said lower surface, wherein said liquid discharge means includes a hollow stem projecting into said opening in said body member, and wherein said push button member engages and is carried by said hollow stem.

19. Apparatus for concurrently puncturing the sidewalls of and moistening elongate, generally cylindrical tobacco products, comprising:

(a) a body member having upper and lower end surfaces and an opening extending therethrough from one of said surfaces to the other of said surfaces, said body member also having at least one pin member having a pointed end thereon and carried by and projecting upwardly from said upper surface;

(b) a container carried by said body member adjacent said lower surface, said container having a liquid therein suitable for moistening tobacco products and having a hollow stem movably mounted thereon and extending in a first direction into said opening of said body member, said container further including means for discharging said fluid through said hollow stem upon downward movement of said stem relative to said container; and (c) a push button member mounted on said stem and movable in said opening of said body member, said push button member having an upper portion thereof projecting upwardly above said upper surface of said body member and having a tobacco-product-receiving bore formed by at least one wall member thereon, said bore having a bore axis extending in a bore direction generally transverse to said first direction and positioned above said pin member, said wall member having an aperture therethrough aligned with said pin member so that when said push button is depressed said wall member moves downwardly past the upper end of said pin member and said pin member projects into said bore, said bore having an open end adapted to receive an end of a tobacco product so that the product projects lengthwise in the bore direction, said bore communicating with said hollow stem, whereby the sidewall of a tobacco product can be punctured and an end portion of the product concurrently moistened by inserting the same in said bore and depressing said push button.

20. Apparatus according to claim 19, wherein said container is elongated and wherein the axis of the elongated container extends in said first direction, whereby said bore direction is generally transverse to the axis of said container.

21. Apparatus according to claim 20, wherein said stem is mounted to said container for movement relative thereto in a direction parallel to the axis of said container.

22. Apparatus according to claim 19, wherein said means for discharging includes a pump disposed within said container and actuated by said stem.

23. Apparatus according to claim 19, wherein said means for discharging includes a vaporizable propellant disposed within said container and a valve linked to said stem for actuation thereby.

24. Apparatus according to claim 19, wherein said liquid is an aqueous liquid.

25. Apparatus according to claim 19, wherein said push button member has a hollow tubular needle projecting in said bore direction within said bore, whereby a tobacco product engaged within said bore will be impaled by said needle, and wherein said needle communicates with said stem, whereby fluid discharged through said stem will be introduced into said tobacco product via said needle.

26. Apparatus according to claim 19, wherein said push button member has a nozzle disposed within said tobacco-product-receiving bore remote from said open end and facing toward said open end and a stop disposed within said bore between said nozzle and said open end so that a tobacco product inserted into said bore will be arrested by said stop and will be remote from said nozzle, said bore communicating with said hollow stem by way of said nozzle so that fluid dispensed to said bore will be projected through said nozzle toward the end of the tobacco product engaged in said bore.

27. Apparatus according to claim 26, wherein said push button member has a bore end wall extending transversely across said tobacco-product-receiving bore and surrounding said nozzle, said bore end wall sloping from said nozzle towards said open end of said bore, said stop including portions of said bore end wall adjacent to the periphery of said bore, whereby the end of a tobacco product inserted into said bore and said bore end wall will cooperatively define a chamber, and fluid discharged through said nozzle will be introduced into said chamber.

* * * * *